United States Patent [19]

Bowden

[11] 4,392,798

[45] Jul. 12, 1983

[54] GEAR PUMP OR MOTOR WITH LOW PRESSURE BEARING LUBRICATION

[75] Inventor: Charles J. Bowden, Battle Creek, Mich.

[73] Assignee: General Signal Corporation, Stamford, Conn.

[21] Appl. No.: 251,003

[22] Filed: Apr. 3, 1981

[51] Int. Cl.[3] ..... F04C 29/02; F04C 2/18; F03C 2/08

[52] U.S. Cl. ..... 418/102; 418/132

[58] Field of Search ..... 418/102, 131, 132

[56] References Cited

U.S. PATENT DOCUMENTS

| | | | |
|---|---|---|---|
| 1,682,842 | 9/1928 | Hamer | 418/79 |
| 1,972,271 | 9/1934 | McIntyre | 418/79 |
| 2,276,107 | 3/1942 | Simons | 418/79 |
| 2,823,616 | 2/1958 | Toyoda | 418/79 |
| 2,986,096 | 5/1961 | Booth et al. | 418/79 |
| 3,447,472 | 6/1969 | Hodges | 418/102 |
| 3,490,382 | 1/1970 | Joyner | 418/102 |
| 3,690,793 | 9/1972 | Pollman et al. | 418/102 |
| 4,090,820 | 5/1978 | Teruyama | 418/102 |
| 4,160,630 | 7/1979 | Wynn | 418/102 |

FOREIGN PATENT DOCUMENTS

| | | | |
|---|---|---|---|
| 897203 | 11/1953 | Fed. Rep. of Germany . | |
| 1776663 | 3/1956 | Fed. Rep. of Germany . | |
| D 19643 | 6/1956 | Fed. Rep. of Germany . | |
| 1528959 | 8/1973 | Fed. Rep. of Germany . | |
| 1386237 | 3/1975 | United Kingdom | 418/102 |

*Primary Examiner*—John J. Vrablik
*Assistant Examiner*—Jane E. Obee
*Attorney, Agent, or Firm*—Pollock, Vande Sande & Priddy

[57] ABSTRACT

An improved gear pump or motor includes seal plates (30, 32) having a lubrication channel (48, 50) communicating between the shaft bearings (18, 20, 22, 24) and the low pressure side of the zone (62) where the gear teeth (58, 60) intermesh. Lubricant flow is directed first through one bearing on one side of the pump and then back through a separate channel (54, 56) to the other bearing on the same side of the pump. Placement of the lubrication channels on the low pressure side of the pump where the volume between intermeshing teeth is increasing and the pressure between the teeth is below inlet pressure ensures that flow reversals in the bearings and lubricant aeration are avoided; and renders bearing flow rate less sensitive to pressure, so that relatively large flow channels may be used in the wear plate.

15 Claims, 4 Drawing Figures

GEAR PUMP OR MOTOR WITH LOW PRESSURE BEARING LUBRICATION

DESCRIPTION

Technical Field

The present invention relates in general to gear pumps or motors and particularly concerns an improved type of seal plate structure which provides for low pressure lubrication of the shaft bearings of such pumps or motors.

BACKGROUND ART

Various attempts have been made in the past to provide adequate lubrication for the bearings of spur gear pumps and motors by bleeding off a portion of the fluid flowing through the apparatus and passing this portion through the shaft bearings. For example, the wear plates next to the gears have been provided with a metering slot extending between the shaft openings of the wear plate, in the zone where the gear teeth intermesh. In such a case, lubricant is forced in parallel via the metering slot through the bearings and then collected and returned to the low pressure side of the apparatus. These long metering slots have the disadvantage that they weaken the seal plate so that high strength, expensive materials must be used. Also, the metering slots or notches are subject to both clogging and erosion which can seriously impair the distribution of lubricant. Moreover, air dissolved in the lubricant tends to be pulled out during flow through the metering notches, which leads to frothing of the lubricant and poor flow through the bearings. Finally, such parallel lubrication of the bearings requires rather large volumes of oil which do not reach the outlet port of the pump, thereby reducing overall efficiency.

Attempts have also been made to direct lubricant flow in series first to one bearing and then to another, to reduce the overall volume of oil required for bearing lubrication. For example, it is known to provide a short metering slot which extends from the zone where the gear teeth intermesh toward only one of the gear shafts, on the high pressure side. In this case, lubricant is forced in series through one bearing via the short metering slot, through a channel in the pump housing to the other bearing, and then returned to the low pressure side. Unfortunately, this prior art design is subject to several of the drawbacks noted previously for the parallel flow pump. Location of the metering slot on the high pressure side requires the use of a carefully sized slot to keep the bearing flow rates within limits, since the high pressure varies under load. Thus, the bearing flow is controlled by the system pressure and is difficult to regulate. Moreover, the metering slot is still subject to clogging and erosion due to its rather small size. As the volume between the gear teeth first decreases and then increase in gear pumps and motors, flow reversals are known to occur in the metering slot which can lead to less desirable lubricant flow patterns and lubricant frothing. Finally, location of the short metering slot on the high pressure side places a large pressure differential on the wear plate which tends to cause increased wear.

Another approach to controlling the lubricant flow through the bearings of a gear pump or motor is disclosed in commonly assigned U.S. Pat. No. 4,160,630, issued to Wynn. This patented device includes wear plates having a flow channel positioned on the low pressure side, the flow channel being exposed to the elevated fluid pressure which exists in the small volumes of fluid caught between the meshed gears of the device. This elevated pressure is used to force lubricant flow through one of the adjacent bearings, along a channel provided in the housing and back through the other bearing on the same idea.

While these small volumes of fluid do experience pressures in excess of the low side pressure over a portion of the gear revolution, it has been found that as the small volumes expand as the gears continue to rotate toward the low pressure side, the pressure of these volumes actually drops below the low pressure for a time. This reduced pressure has been used in some prior art pumps as a means to draw lubricant from one of the adjacent shaft bearings into the small volume from which it escapes to the inlet side of the pump. Simultaneously, lubricant is drawn into other pump bearings. U.S. Pat. Nos. 3,447,472 issued to Hodges et al and 3,490,382 issued to Joyner disclose such systems, as does West German Pat. No. 1,528,959 issued to Weigert.

Although these prior art pump designs have achieved varying degrees of success, seal plate geometries have tended to be rather complex and often the plates have had different geometries on opposite sides of the gears. So, a need has continued to exist for a gear pump or motor in which the seal plates are of considerably simplified geometry which does not require such precise positioning of flow channels or the use of opposite-handed seal plates on the opposite sides of the gears.

Disclosure of the Invention

An object of the invention is to provide a gear pump or motor having an improved wear plate, by means of which lubricant flow is directed in series through shaft bearings on the same side of the gears.

Another object of the invention is to provide such a pump or motor with a wear plate having a flow channel for lubricant which extends from the zone of intermeshing teeth on the low pressure side.

A further object of the invention is to provide such a pump or motor with a wear plate having a lubricant flow channel which is offset from the center portion of the wear plate between the gear shaft openings, whereby wear plate strength is improved.

Yet another object of the invention is to provide such a pump or motor having a wear plate in which the lubricant flow channels are enlarged to reduce aeration of the flowing lubricant.

A still further object of the invention is to provide such a pump or motor in which the pressure drop across the wear plate due to lubricant flow therethrough is reduced to provide enhanced wear plate life.

Still another object of the invention is to provide such a pump or motor with a wear plate having lubricant flow channels located relative to the zone of intermeshing gear teeth so that flow reversals in the channels are avoided.

Yet another objective is to provide such a gear pump or motor in which the same seal plate is used on both sides of the gears.

These objects are given only by way of example. Thus, other desirable objects and advantages inherently achieved by the disclosed invention may be apparent to those skilled in the art. Nonetheless, the scope of the invention is to be limited only by the appended claims.

In a preferred embodiment of the invention, the rotary gear pump or motor comprises a housing having low pressure and high pressure chambers and a pair of shafts mounted for rotation in the housing on bearings supported by the housing. A pair of gears are mounted, one on each shaft, the gears having teeth which intermesh at a zone between the low and high pressure chambers so that the teeth sequentially define initially contracting and then expanding volumes therebetween as the gears intermesh in this zone. Means are provided on each side of the gears for receiving fluid from a first adjacent one of the shaft bearings on one side of the gears, directing the fluid into the low pressure chamber and directing fluid from the low pressure chamber to a second adjacent one of the shaft bearings on the same side of the gears. A flow channel is provided in the housing for receiving fluid from one bearing and directing it to the other.

In the preferred embodiment, the previously mentioned receiving and directing means comprises a pair of seal plates, at least one plate being mounted on each side of the gears between the shaft bearings and the gears with the shafts extending through the seal plates. A first channel is provided in the seal plates which originates adjacent to the intermeshing zone at a location in which the first channel is open to receive fluid from a first one of the shaft bearings on one side of the gears and to direct this fluid into an expanding one of the volumes between the gears. A second channel also is provided in the seal plates which originates at the low pressure chamber and directs fluid to a second adjacent one of the shaft bearings on the same side of the gears as the first bearing. Preferably, the first channel comprises a slot in the side of the seal plate which faces the gears, the slot extending radially inwardly from the previously mentioned location essentially toward the center of the first bearing. Similarly, the second channel preferably comprises a slot in the side of the seal plate facing the bearings, this slot extending radially inwardly from the inlet chamber essentially toward the center of the second bearing.

BEST MODE FOR CARRYING OUT THE INVENTION

Figure 4:
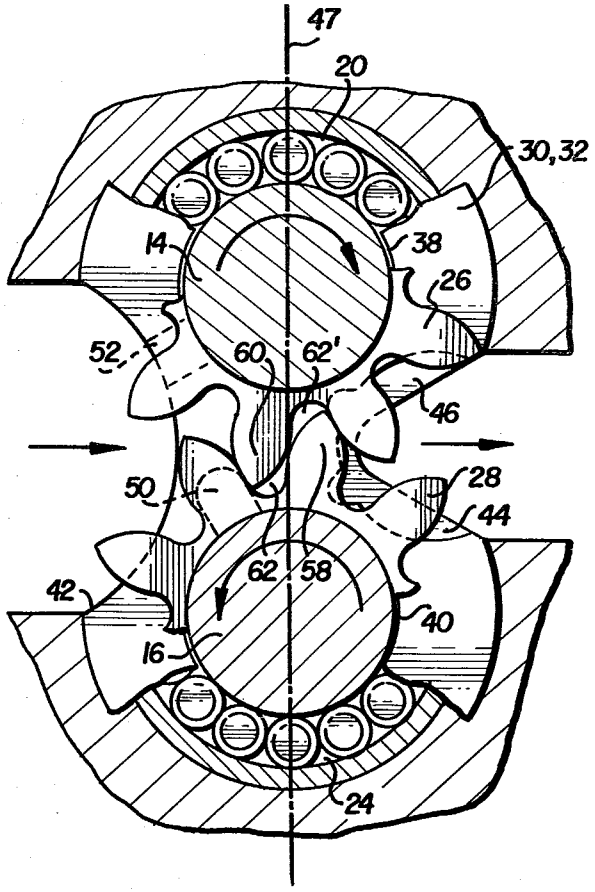
FIG. 4 shows a section, partially broken away, taken along line 4—4 of FIG. 1, indicating the cooperation between the gear teeth and the lubrication channels in the wear plate and the location of the lubrication channels relative to the gear teeth and the pump inlet.

There follows a detailed description of the preferred embodiment of the invention, reference being made to the drawings in which like reference numerals identify like elements of structure in each of the several Figures.

Figure 1:
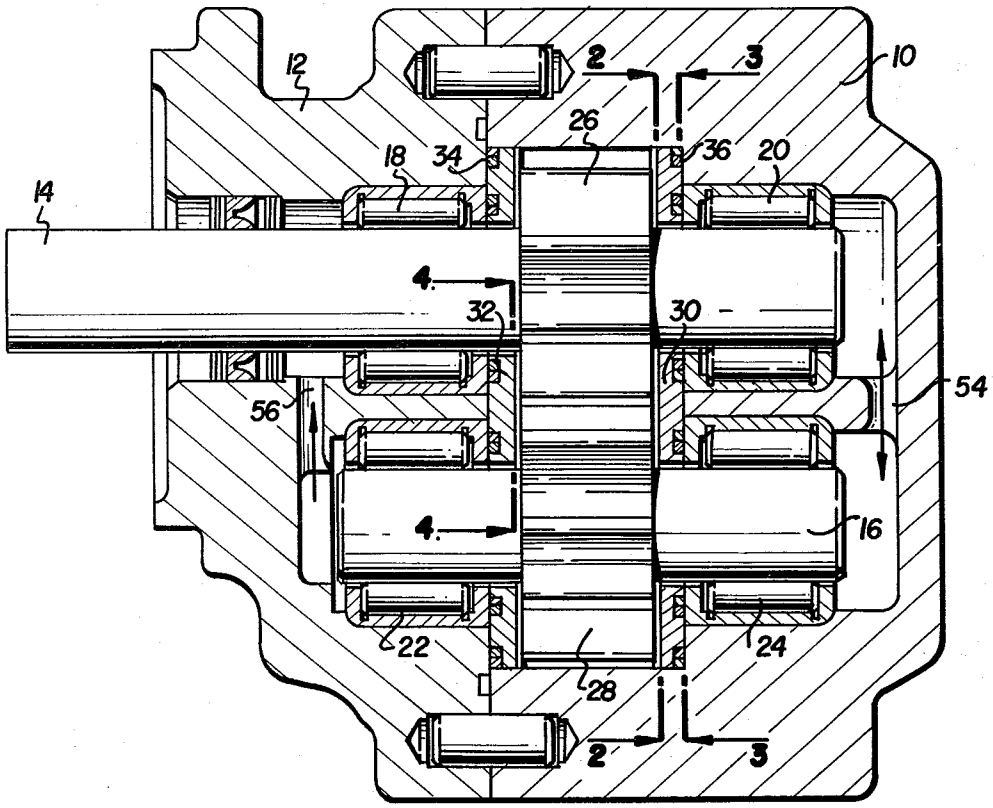
FIG. 1 shows an elevation section through a gear pump embodying the invention.

FIG. 1 shows an elevation section through a gear pump embodying the invention. Of course, the principles of the invention also may be applied to gear motors, as will be understood by those skilled in the art. A housing 10 and closure or adapter 12 support a pair of parallel shafts, a drive shaft 14 and a driven shaft 16, via shaft roller bearings 18, 20, 22 and 24. A drive gear 26, mounted for rotation with drive shaft 14, meshes with a driven gear 28 mounted for rotation with driven shaft 16. Between the gears 26, 28 and housing 10, a wear plate 30 is provided which bears against a ledge in housing 10 in the conventional manner. A wear plate 32, identical in geometry to wear plate 30 but inverted as installed, is provided between gears 26, 28 and closure 12. W-shaped seals 34 and 36, of known design, are provided in grooves in wear plates 30, 32 to seal the pump inlet chamber from the outlet chamber. See also FIG. 3.

Figure 2:
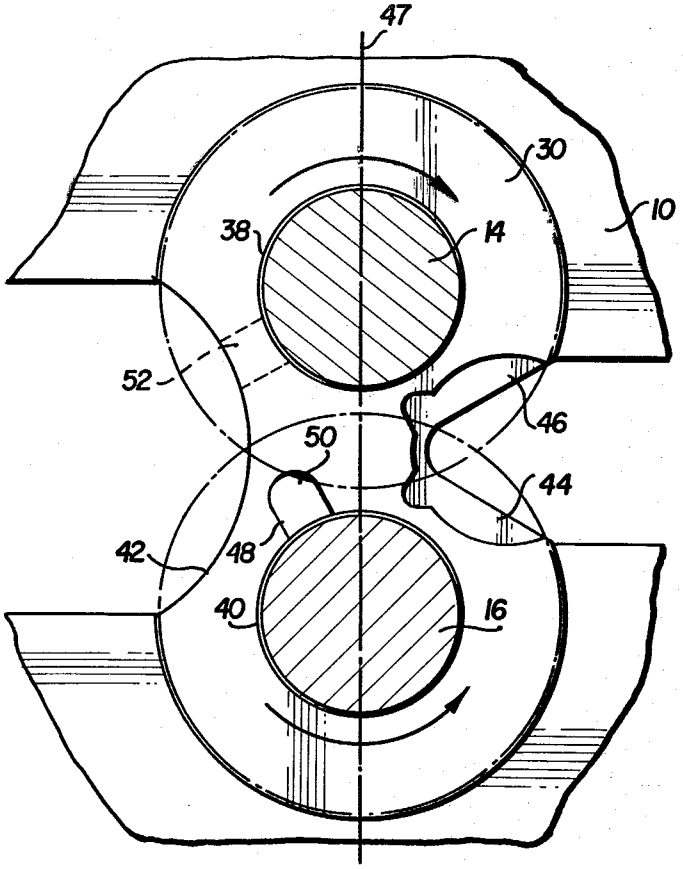
FIG. 2 shows a section taken along line 2—2 of FIG. 1, indicating the details of the gear side of the seal plate.

Referring to FIG. 2, the gear side of wear plate 30 is seen to have a generally figure eight shaped configuration. Plate 30 may be of aluminum or other suitable material and includes a pair of spaced bores 38, 40 through which shafts 14 and 16 extend, respectively. Preferably, the surface of the plate facing the gears is hardened to reduce wear. An inlet port relief 42 is cut away on the inlet chamber side of the plate; and an outlet port relief 44, on the outlet chamber side. A pressure relief slot 46 is machined into the surface of the plate 30 in position to permit pressure equalization between the fluid trapped between intermeshing gear teeth and the fluid in the outlet chamber, as the gear teeth begin to mesh. This prevents the generation of excessively high pressures in the volume between the gear teeth in the zone of intermeshing teeth located between the inlet and outlet chambers, in the familiar manner.

Figure 3:
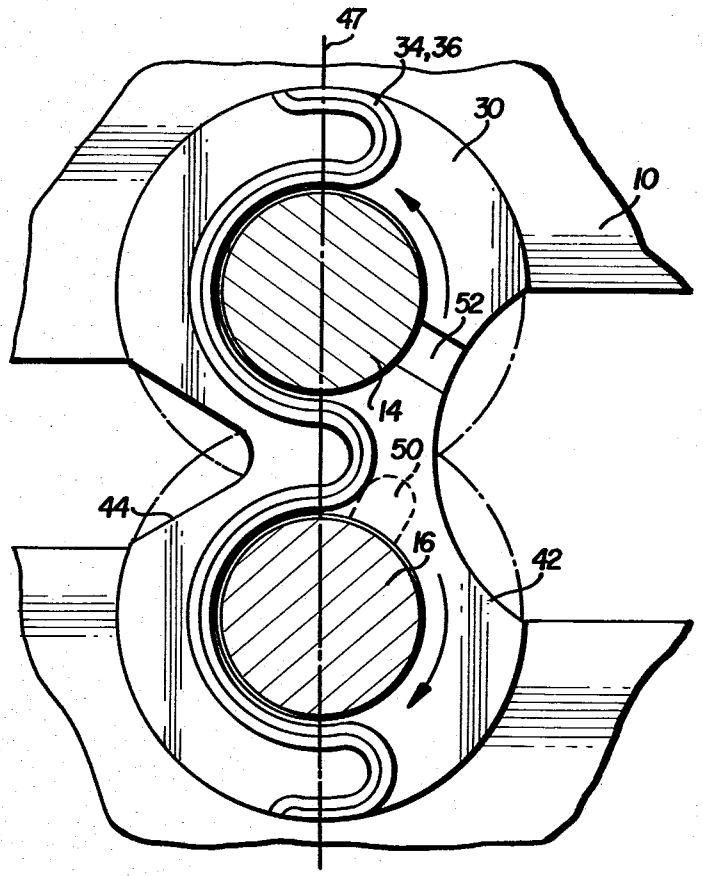
FIG. 3 shows a section taken along line 3—3 of FIG. 1, indicating the details of the bearing side of the seal plate.

On the inlet chamber side of a line 47 extending between the centers of bores 38 and 40, a lubricant flow channel 48 is provided which includes a recessed portion or slot 50 cut into the face of plate 30. Slot 50 extends radially inwardly toward bore 40 and the axial center of shaft 16 and bearing 24. Slot 50 is located to receive lubricant flowing through bore 40 from the roller and cage area of the adjacent bearing 24 and to direct this lubricant to the inlet chamber. The specific location of recessed portion 50 will be discussed with respect to FIG. 4. As indicated previously, wear plate 32 is identical to wear plate 30, but is installed in an inverted position from that shown in FIG. 2, with recess 50 communicating with the clearance between bore 40 and shaft 14. FIG. 3 shows the bearing side of wear plate 30 which includes a slot 52 extending from bore 38 radially outwardly to communicate with the inlet chamber of the pump.

The configuration of W-seals 34, 36 permits isolation of the inlet and outlet chambers except for the small amount of fluid carried through the intermeshing zone between the gear teeth from inlet to outlet. In operation, as the gear teeth move through their intermeshing zone, the small volume between the teeth begins to open toward the pump inlet so that the pressure in each small volume actually drops somewhat below the inlet pressure. With reference to FIGS. 2–4, this drop in pressure causes lubricant to be drawn from bearing 24, through bore 40, into slot 50 and finally into the small volume between the teeth. From there it is released to the inlet of the pump. This flow of lubricant causes a further flow from the inlet through slot 52, through bore 38 and into bearing 20 from which it passes through passage 54 provided in housing 10 and then back through bearing 24. However, on the opposite side of the gears, as illustrated, the lubricant is drawn from bearing 18, through bore 40, into slot 50 and discharged to the inlet chamber. Simultaneously, the lubricant is forced through slot 52, through bore 38, into bearing 22 and through passage 56 in adaptor 12 to complete the circuit.

FIG. 4 shows a fragmentary view of a pump embodying the invention, particularly the location of slot 50 relative to gears 26, 28 and inlet port relief 42. As gears 26 and 28 begin to intermesh, a small amount of fluid is trapped between teeth 58 and 60 in a volume 62. Initially, volume 62 decreases in size as the gears rotate, thereby compressing the small amount of fluid and raising the pressure in volume 62. As previously mentioned, relief slot 46 initially prevents this pressure from reaching excessive levels when the gears first mesh. As the gears continue to mesh, volume 62 eventually will begin to increase in size as it is moved past center line 47. Due to the change in volume 62 as the gears rotate, its pressure will rise rapidly to a peak value when the volume is smallest and then fall rapidly as the volume expands, eventually dropping somewhat below inlet pressure. Slot 50 is located according to the invention on the inlet side of line 47 so that it is exposed to successive volumes 62 at a time when not only is the volume increasing, but also the pressure in the volume is below inlet pressure. Of course, at this time the volume will not have opened completely to the inlet chamber. The exact location of slot 50 will vary somewhat with tooth geometry; however, it is readily determined. Thus, the necessary pressure differential is provided to draw fluid through bore 40 from bearing 24 and into slot 50. On the other side of the gears, a different volume 62' is used to draw the lubricant through bearings 18 and 22.

Placement of slot 50 on the inlet side of line 47 is important to the operation of the invention. If slot 50 were placed on the outlet side of the pump, it would be subjected to substantially higher pressures. To keep the flow rates through the bearings within reasonable limits at these high pressures, the slot would have to be made rather small to meter the flow. As mentioned previously, such an arrangement is susceptible to clogging, erosion and aeration problems. On the other hand, if the recess were placed so that it was exposed to volume 62 as the volume displacement rapidly decreased, it would be subjected to a series of short pressure transients or spikes. Such variations lead to corresponding up and down fluctuations in flow rate through the bearings, which are thought to cause flow reversals of the lubricant and aeration.

However, when slot 50 is located on the low pressure side of line 47, as in the present invention, various advantages result. Since the pressure in volumes 62 and 62' is relatively low at this location, slot 50 need not be small to meter the flow, with the result that the wear plate is less sensitive to erosion and clogging. The successive volumes 62, 62' thus become the only effective means to meter the flow into the bearings. Also, the lower pressure at the inlet of slot 50 means a smaller pressure differential across the wear plate, which reduces wear.

Having described my invention in sufficient detail to enable those skilled in the art to make and use it, I claim:

1. An improved rotary gear apparatus comprising:

a housing having low pressure and high pressure chamber;

a pair of shafts mounted for rotation in said housing on bearings supported by said housing;

a pair of gears, one mounted on each of said shafts, said gears having teeth intermeshing at a zone between said low pressure chamber and said high pressure chamber, said teeth sequentially defining initially contracting and then expanding volumes therebetween as said gears intermesh in said zone;

means mounted on each side of said gears for receiving fluid only from a first adjacent one of said bearings on one side of said gears, for passing said fluid directly into one of said expanding volumes and for passing fluid from said low pressure chamber only to a second adjacent one of said bearings on the same side of said gears; and means for receiving fluid only from said second adjacent bearing and directing said fluid only into said first adjacent bearing.

2. Apparatus according to claim 1, wherein said receiving and passing means comprises a pair of seal plates, one seal plate mounted on each side of said gears between said gears and said bearings with said shafts extending through said seal plates.

3. Apparatus according to claim 1, wherein said receiving and passing means comprises a first channel originating adjacent to said zone at a location in which said first channel is open to receive fluid from said first adjacent bearing and to pass said fluid directly into one of said expanding volumes.

4. Apparatus according to claim 3, wherein said receiving and passing means comprises a pair of seal plates, one seal plate mounted on each side of said gears between said gears and said bearings with said shafts extending through bores in said seal plates; and said first channel comprises a slot in the side of said seal plate facing said gears, said slot extending radially inwardly from said location essentially toward the center of said first adjacent bearing.

5. Apparatus according to claim 4, wherein the seal plates on opposite sides of said gears are geometrically identical but inverted relative to said gears and shafts.

6. Apparatus according to claim 4, wherein said receiving and passing means comprises a second channel originating at said low pressure chamber for passing fluid to said second adjacent bearing.

7. Apparatus according to claim 6, wherein said receiving and passing means comprises a pair of seal plates, one seal plate mounted on each side of said gears between said gears and said bearings with said shafts extending through bores in said seal plates; and said second channel comprises a slot in the side of said seal plate facing said bearings, said slot extending radially inwardly from said low pressure chamber essentially toward the center of said second adjacent bearing.

8. Apparatus according to claim 7, wherein the seal plates on opposite sides of said gears are geometrically identical but inverted relative to said gears and shafts.

9. Apparatus according to claim 1, wherein said receiving means comprises a passage in said housing extending from the axially outermost end of said second adjacent bearing to the axially outermost end of said first adjacent bearing.

10. An improved rotary gear apparatus, comprising:

a housing having low pressure and high pressure chamber;

a pair of shafts mounted for rotation in said housing on bearings supported by said housing;

a pair of gears, one mounted on each of said shafts, said gears having teeth intermeshing at a zone between said low pressure chamber and said high pressure chamber, said teeth sequentially defining initially contracting and then expanding volumes therebetween as said gears intermesh in said zone;

at least a pair of seal plates, at least one plate mounted on each side of said gears between said bearings and said gears with said shafts extending through bores in said seal plates;

first channel means in each of said seal plates, said first channel means originating on the side of said seal plate facing said gears adjacent to said zone and opening into one of said bores, for receiving fluid only from a first adjacent one of said bearings on one side of said gears and for passing said fluid directly into an expanding one of said volumes;

second channel means in each of said seal plates, said second channel means originating on the opposite side of said seal plate at said low pressure chamber, for passing fluid only to a second adjacent one of said bearings on the same side of said gears; and means for receiving fluid only from said second adjacent bearing and passing said fluid only into said first adjacent bearing.

11. Apparatus according to claim 10, wherein said first channel means comprises a slot in said side of said seal plate facing said gears, said slot extending radially inwardly essentially toward the center of said first adjacent bearing.

12. Apparatus according to claim 10, wherein said second channel means comprises a slot in said opposite side of said seal plate facing said bearings, said slot extending radially inwardly from said low pressure chamber essentially toward the center of said second adjacent bearing.

13. Apparatus according to claim 10, wherein said receiving means comprises a passage in said housing extending from the axially outermost end of said second adjacent bearing to the axially outermost end of said first adjacent bearing.

14. Apparatus according to claim 10, wherein the seal plates on opposite sides of said gears are geometrically identical but inverted relative to said gears and shafts.

15. Apparatus according to claim 10, wherein said seal plates have an essentially figure eight configuration, further comprising seal means on the side of said plates facing said bearings, for separating said low pressure and high pressure chambers.

* * * * *